US007370701B2

(12) United States Patent
Surjaatmadja et al.

(10) Patent No.: US 7,370,701 B2
(45) Date of Patent: May 13, 2008

(54) WELLBORE COMPLETION DESIGN TO NATURALLY SEPARATE WATER AND SOLIDS FROM OIL AND GAS

(75) Inventors: Jim B. Surjaatmadja, Duncan, OK (US); Billy W. McDaniel, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 336 days.

(21) Appl. No.: 10/881,223

(22) Filed: Jun. 30, 2004

(65) Prior Publication Data

US 2006/0000607 A1 Jan. 5, 2006

(51) Int. Cl.
*E21B 43/38* (2006.01)

(52) U.S. Cl. ..... 166/265; 166/50; 210/747; 210/803

(58) Field of Classification Search ..... 166/265, 166/50; 210/747, 803, 804
See application file for complete search history.

(56) References Cited

U.S. PATENT DOCUMENTS

| | | | | |
|---|---|---|---|---|
| 1,618,151 A | | 2/1927 | Fisher | |
| 1,743,179 A | | 1/1930 | Zeb | |
| 2,206,835 A | | 7/1940 | Combs | 210/540 |
| 2,760,635 A | | 8/1956 | Dahlstrom | |
| 2,917,173 A | | 12/1959 | Rakowsky | |
| 2,946,439 A | | 7/1960 | Condolios et al | |
| 2,952,319 A | * | 9/1960 | Lee | 166/283 |
| 3,862,039 A | | 1/1975 | Summers | 210/252 |
| 4,216,095 A | | 8/1980 | Ruff | 210/512 |
| 4,241,787 A | | 12/1980 | Price | 166/105 |
| 4,271,010 A | | 6/1981 | Guarascio | 209/211 |

(Continued)

FOREIGN PATENT DOCUMENTS

GB 2326895 1/1999

(Continued)

OTHER PUBLICATIONS

S.P. Engel and Phil Rae, "New Methods for Sand Cleanout in Deviated Wellbores Using Small Diameter Coiled Tubing," IADC/SPE 77204, Society of Petroleum Engineers, © 2002, 6 pages.

(Continued)

*Primary Examiner*—Hoang Dang
(74) *Attorney, Agent, or Firm*—Paul R. Morico

(57) ABSTRACT

A wellbore completion design is provided, which creates a convective flow action that separates water and sand from hydrocarbons during production of the hydrocarbons from a subterranean formation. A deviated section of the wellbore creates the desired effect. The wellbore completion design may include a secondary bore, which intersects the deviated section of the wellbore at an acute angle, to accumulate the separated water and sand. An injection pump disposed in the toe section of the secondary bore can also be employed to pump the water back into the water containing portion of the subterranean formation. If solids are present in more than trace amounts, the toe section of the secondary bore may be formed at an acute angle to the remaining portion of the secondary bore to prevent blockage of the pump. Alternatively, a tertiary bore may be provided, so that the solids can accumulate in the secondary bore and the water can flow into the tertiary bore.

66 Claims, 6 Drawing Sheets

U.S. PATENT DOCUMENTS

| | | | | |
|---|---|---|---|---|
| 4,296,810 | A | 10/1981 | Price | 166/265 |
| 4,818,375 | A | 4/1989 | Dorph | 209/18 |
| 4,886,599 | A | 12/1989 | Bachmann et al. | 210/287 |
| 4,938,878 | A | 7/1990 | Hall | 210/744 |
| 5,013,435 | A | 5/1991 | Rider et al. | 210/262 |
| 5,127,457 | A | 7/1992 | Stewart et al. | 166/306 |
| 5,224,604 | A | 7/1993 | Duczmal et al. | 209/12 |
| 5,296,153 | A | 3/1994 | Peachey | 210/787 |
| 5,336,396 | A | 8/1994 | Shetley | 210/90 |
| 5,425,416 | A | 6/1995 | Hammeke et al. | 166/105.5 |
| 5,443,120 | A | 8/1995 | Howell | 166/265 |
| 5,456,837 | A | 10/1995 | Peachey | 210/512.2 |
| 5,570,744 | A | 11/1996 | Weingarten et al. | 166/357 |
| 5,597,493 | A | 1/1997 | Torini | 210/799 |
| 5,693,225 | A | 12/1997 | Lee | 210/512.2 |
| 5,779,917 | A | 7/1998 | Brister | 210/800 |
| 5,837,152 | A | 11/1998 | Komistek et al. | 210/801 |
| 5,857,519 | A | 1/1999 | Bowlin et al. | 166/105.6 |
| 5,899,270 | A | 5/1999 | Watson | 166/105.5 |
| 5,961,841 | A | 10/1999 | Bowers | 210/739 |
| 5,988,275 | A | 11/1999 | Brady et al. | 166/105.5 |
| 5,992,521 | A | 11/1999 | Bergren et al. | 166/265 |
| 5,996,690 | A | 12/1999 | Shaw et al. | 166/250.01 |
| 6,015,011 | A | 1/2000 | Hunter | 166/265 |
| 6,056,054 | A | 5/2000 | Brady et al. | 166/265 |
| 6,068,053 | A | 5/2000 | Shaw | 166/267 |
| 6,082,452 | A | 7/2000 | Shaw et al. | 166/105.5 |
| 6,089,317 | A | 7/2000 | Shaw | 166/265 |
| 6,099,742 | A | 8/2000 | Komistek | 210/540 |
| 6,131,655 | A | 10/2000 | Shaw | 166/105.5 |
| 6,142,224 | A | 11/2000 | Stuebinger et al. | 166/105.5 |
| 6,152,218 | A | 11/2000 | Safargar | 166/105.1 |
| 6,173,774 | B1 | 1/2001 | Fox | 166/265 |
| 6,189,613 | B1 | 2/2001 | Chachula et al. | 166/265 |
| 6,196,312 | B1 | 3/2001 | Collins et al. | 166/265 |
| 6,196,313 | B1 | 3/2001 | Simons | 166/266 |
| 6,202,744 | B1 | 3/2001 | Shaw | 166/106 |
| 6,209,641 | B1 | 4/2001 | Stevenson | 166/266 |
| 6,277,286 | B1 | 8/2001 | S.o slashed.ntvedt et al. | 166/250.03 |
| 6,336,503 | B1 | 1/2002 | Alhanati et al. | 166/265 |
| 6,336,504 | B1 | 1/2002 | Alhanati et al. | 166/265 |
| 6,367,547 | B1 | 4/2002 | Towers et al. | 166/265 |
| 6,379,567 | B1 | 4/2002 | Crites | 210/788 |
| 6,382,316 | B1 | 5/2002 | Kintzele | 166/265 |
| 6,478,953 | B2 | 11/2002 | Spearman et al. | 210/130 |
| 6,543,537 | B1 | 4/2003 | Kjos | 166/266 |
| 6,547,003 | B1 | 4/2003 | Bangash et al. | 166/106 |
| 6,550,535 | B1 | 4/2003 | Traylor | 166/265 |
| 6,627,081 | B1 | 9/2003 | Hilditch et al. | 210/512.2 |
| 6,672,385 | B2 | 1/2004 | Kilaas et al. | 166/250.01 |
| 6,691,781 | B2 | 2/2004 | Grant et al. | 166/265 |
| 6,719,048 | B1 | 4/2004 | Ramos et al. | 166/250.15 |
| 6,761,215 | B2 | 7/2004 | Morrison et al. | 166/105.5 |
| 6,868,907 | B2 | 3/2005 | Homstvedt et al. | 166/265 |
| 6,868,911 | B1 | 3/2005 | Jacobson et al. | 166/369 |
| 6,880,402 | B1 | 4/2005 | Couet et al. | 73/579 |
| 2001/0017207 | A1* | 8/2001 | Haheim | 166/265 |
| 2002/0084073 | A1 | 7/2002 | Underdown et al. | 166/265 |
| 2002/0153326 | A1 | 10/2002 | Oddie | 210/747 |
| 2002/0189807 | A1 | 12/2002 | Emanuele et al. | 166/266 |
| 2003/0037923 | A1* | 2/2003 | Emanuele et al. | 166/265 |
| 2003/0051874 | A1 | 3/2003 | Munson et al. | 166/265 |
| 2003/0079876 | A1 | 5/2003 | Underdown | 166/265 |
| 2003/0145991 | A1 | 8/2003 | Olsen | 166/265 |
| 2004/0069494 | A1 | 4/2004 | Olsen et al. | 166/357 |
| 2004/0104027 | A1 | 6/2004 | Rossi et al. | 166/250.15 |
| 2004/0134654 | A1 | 7/2004 | Snow | 166/265 |

FOREIGN PATENT DOCUMENTS

| | | |
|---|---|---|
| WO | WO 96/03566 | 2/1996 |
| WO | WO 97/25150 | 7/1997 |
| WO | WO 98/37307 | 8/1998 |
| WO | WO 98/41304 | 9/1998 |
| WO | WO 00/65197 | 11/2000 |
| WO | WO 01/23707 | 4/2001 |
| WO | WO 02/14647 | 2/2002 |
| WO | WO 03/062597 | 7/2003 |
| WO | WO 2004/053291 | 6/2004 |

OTHER PUBLICATIONS

Jim B. Surjaatmadja, "Well Intervention Using Coiled Tubing for Sweep-Cleaning Out of Deviated Wellbores and Accurate Placement of Multiple Fractures in Vertical and Deviated Wellbores," 10th European Coiled Tubing and Well Intervention Roundtable, International Coiled Tubing Association Society of Petroleum Engineers, Nov. 16-17, 2004, 10 pages.

PCT International Search Report and Written Opinion dated Sep. 27, 2007 for U.S. Appl. No. PCT/US2006/016724.

Office Action dated Jul. 6, 2007 for U.S. Appl. No. 11/119,956.

* cited by examiner

WELLBORE COMPLETION DESIGN TO NATURALLY SEPARATE WATER AND SOLIDS FROM OIL AND GAS

BACKGROUND

The present invention is directed generally to methods of separating water and solids from oil and gas and more particularly to a wellbore completion design that separates water and solids from oil and gas downhole in such a way that the water and solids remain downhole. These solids will usually consist of granular to very fine sized formation solids, or solids introduced into the well during drilling, completion, stimulation, or production operations.

One of the most burdensome aspects of producing hydrocarbons from a well for well operators is dealing with the presence of solids and water in the hydrocarbons. It is not desirous to have either of these by-products present in the hydrocarbons. Indeed, the presence of these elements in hydrocarbons only inhibits their recovery, often to the degree that economics will force an operator to suspend or even abandon well production. Accordingly, well operators have had to develop techniques for removing or separating the sand and water from the hydrocarbons as nature itself in most wells lends no assistance in this regard. Many of the techniques developed to deal with the removal of these elements, however, are cumbersome, expensive, not always environmentally friendly and often involve complex processes and equipment.

One conventional technique for removing sand from the hydrocarbons is to install sand screens at the end of the production pipe or inside the wellbore through the producing interval. These sand screens typically comprise multiple layers of wire mesh. The pore sizes of these screens are usually selected to filter out or remove as many granules of sand present in a particular formation as possible. Thus, the screens can be, and often are, customized for a particular application. Thus, one screen does not usually "fit all." Accordingly, well operators are required to learn as much about the nature of the formations they will be producing from to insure that they select the right sand screen to filter out as much of the sand as possible.

There are two major drawbacks to using sand screens for removing sand from hydrocarbons. First, over time the sand screens begin to plug up. This causes a decrease in the amount of hydrocarbons being produced. Eventually, the sand screens plug up entirely, requiring either removal of the sand screen or invocation of an operation to clean the sand screens, downhole. Typically, either operations will require the well to be shut down, which in turn ceases the production of hydrocarbons, and causes an additional economic loss to the well owner. Another major drawback of using sand screens attached to the production tubing is that eventually sand bridges form between the sand screen and the wellbore wall. These sand bridges block the flow of remedial treatment fluids, which occasionally need to be pumped downhole through the annulus between the production tubing and the wellbore. To unblock the sand bridges, the well often has to be shut down so that the sand screen can be removed for cleaning. This again results in an economic loss to the well owner.

Another technique for removing sand and other debris from the hydrocarbons being produced from a well is to employ a device at the surface, known as a separator; in some cases, specifically a sand separator. This technique involves producing the sand with the hydrocarbons. A drawback of this approach, however, is that the separator devices take up space at the surface, which is often limited in off-shore applications. Furthermore, it reduces the producing rate of the well, requires repeated cleaning or maintenance, and may be a separate additional device needed additional to a water separator system.

Water is usually removed from the hydrocarbons at the surface using multi-phase separation devices. These devices operate to agglomerate and coalesce the hydrocarbons, thereby separating them from the water. A drawback of this approach, however, is that no separation process is perfect. As such, some amount of the hydrocarbons always remains in the water. This can create environmental problems when disposing of the water, especially in off-shore applications. Also, the multi-phase separation devices are fairly large in size, which is another disadvantage in off-shore applications, as space is limited as pointed out above. Another limitation is that this can require additional maintenance or repair if solids are part of the produced fluid stream.

SUMMARY

The present invention is directed to a wellbore configuration that separates water and solids from oil and gas downhole in such a way that the water and solids remain downhole.

In one embodiment, the present invention is directed to a method of separating other fluids and solids from hydrocarbons being produced from a subterranean formation. The method comprises the step of forming a primary wellbore having a deviated section in the subterranean formation, which stimulates convective separation of the other fluids and solids from the hydrocarbons during production of the hydrocarbons from the subterranean formation. The method may include the additional step of forming a secondary bore, which intersects the deviated section of the primary wellbore at an acute angle into which is accumulated one or more of the other fluids and solids separated from the hydrocarbons. The present invention may further comprise the step of drilling a tertiary bore, which intersects the secondary bore at an acute angle such that the solids accumulate in the secondary bore and the fluids accumulate in the tertiary bore. In yet another aspect of the present invention, perforations and/or fractures may be formed in either the secondary bore or the tertiary bore and a pump may be employed to pump the fluids back into the formation.

In another embodiment, the present invention is directed to an improved wellbore design, which is adapted to separate other fluids and solids from hydrocarbons being produced from the subterranean formation. The wellbore comprises a primary bore having a deviated section, which stimulates convected separation of the other fluids and solids from hydrocarbons during production of the hydrocarbons from the subterranean formation. The wellbore according to the present invention may further comprise a secondary bore, which intersects the deviated section of the primary wellbore at an acute angle and which accumulates one or more of the other fluids and/or solids separating the hydrocarbons. In yet another embodiment, the wellbore according to the present invention may further comprise a tertiary bore which intersects the secondary bore at an acute angle and a pump for pumping the fluids back into the formation.

The features and advantages of the present invention will be readily apparent to those skilled in the art upon a reading of the description of the exemplary embodiments that follows.

BRIEF DESCRIPTION OF THE DRAWINGS

A more complete understanding of the present disclosure and advantages thereof may be acquired by referring to the following description taken in conjunction with the accompanying drawings, which.

DETAILED DESCRIPTION

The present invention is directed to a wellbore completion design that separates water and solids from oil and gas downhole in such a way that the water and solids remain downhole.

Figure 1:
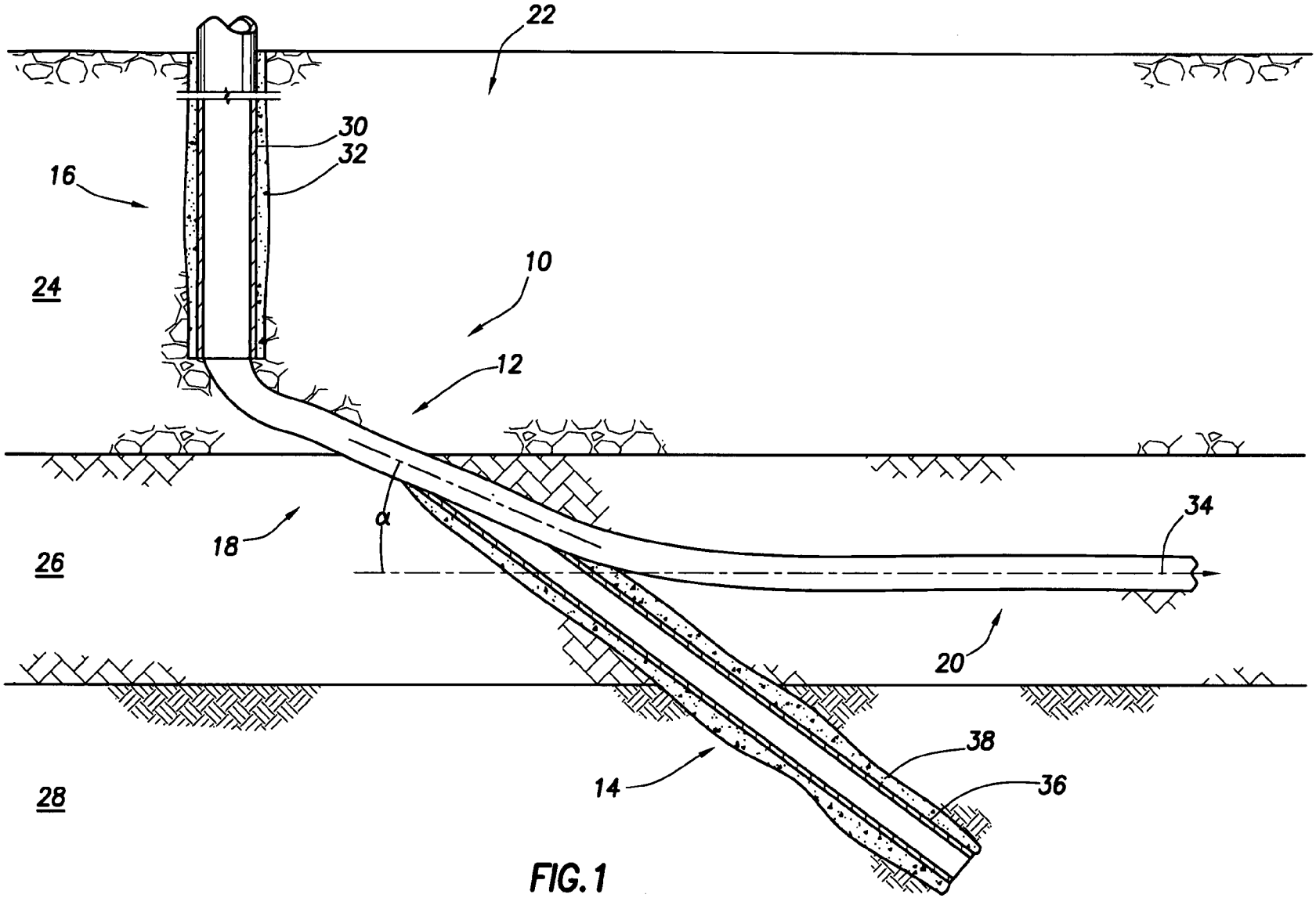
FIG. 1 is a schematic diagram of one embodiment of a wellbore configuration in accordance with the present invention, which stimulates convective separation of other fluids and solids from hydrocarbons being produced from a subterranean formation.

The details of the wellbore completion design in accordance with the present invention will now be described with reference to the accompanying drawings. Turning to FIG. 1, one embodiment of a wellbore configuration is shown generally by reference numeral 10. The wellbore 10 comprises a primary bore 12 and a secondary bore 14. The primary bore 12 in turn comprises a vertical section 16, deviated section 18 and a horizontal section 20. The secondary bore 14 is deviated from the deviated section 18 or the horizontal section 20 and intersects the deviated section 18 or the horizontal section 20 at an acute angle.

The wellbore 10 is formed in subterranean formation 22 by conventional drilling or equivalent techniques. Subterranean formation 22 in turn comprises an inactive or dead zone 24, a producing zone 26, and a water containing zone 28. As can be seen from FIG. 1, the vertical section 16 of the primary bore 12 is most often formed in a zone 24 of the subterranean formation 22 that is non-productive, or not being produced, a highly deviated section 18, which may or may not be within the producing section, and horizontal section 20 formed in the producing zone 26 of the subterranean formation. The secondary bore 14 transverses into both the producing zone 26 and the water containing zone 28. The deviated and horizontal sections 18 and 20 of the primary bore 12 and the secondary bore 14 are formed by conventional directional drilling or equivalent techniques.

The vertical section 16 of the primary bore 12 of the wellbore 10 may be lined with a casing string 30, which may be cemented 32 to the dead zone 24 of the subterranean formation 22. This step can be accomplished using conventional casing techniques. The deviated section 18 of the primary bore 12 and the horizontal section 20 of the primary bore 12 may also be lined with a casing string, which may also be cemented to the subterranean formation 22. Those of ordinary skill in the art will appreciate the circumstances under which the various sections of the primary bore 12 should be lined with a casing string and whether the casing string should be cemented to the subterranean formation 22.

The horizontal section 20 of the primary bore 12 is the main section from which the hydrocarbons will be drawn from the subterranean formation. This can be accomplished through several well known techniques. For horizontal wellbores, the most common method currently is to leave the drilled wellbore in this section as an open hole without casing or liner; or by using a liner where the annulus between the formation and the liner is not cemented. This allows the free flow of formation fluids into the openhole. In some wells, the deviated section 18 and the horizontal section 20 have a cemented casing. If a non-cemented liner is used, at least some portions of this liner may contain sections of the pipe that are pre-slotted or have pre-drilled perforations, as is well understood by those skilled in the art. In the case of using a solid liner or a cemented casing, after placement into sections 18 and 20, the liner or the casing and cement sheath will usually be connected to the reservoir 26 by forming a plurality of perforations along the length of the horizontal section 20 (and possibly deviated section 18 also) of the primary bore 12. This can be accomplished by any one of a number of techniques, including, e.g., but not limited to, conventional explosive charge perforating techniques or by hydrajetting the perforations. In some cases, this may be followed by conventional damage removal or stimulation techniques such as acidizing or hydraulic fracturing. It may be desirable that all or a substantial portion of the deviated section 18 of the primary bore 12 not be perforated or fractured. Indeed, it is in this section that the convective separation of the hydrocarbons from other fluids and solids can most easily take place. The presence of perforations and/or fractures in this region may interfere with this process. To facilitate this convective separation, which will be explained immediately below, at least a significant length (possibly about one hundred feet (100 ft)) of the deviated section 18 of the primary bore 12 should not be perforated. Furthermore, to facilitate the separation process, the deviation section 18 of the primary bore 12, should be oriented at an acute angle $\alpha$ to the horizontal, which is designated by reference number 34. The horizontal line 34 generally forms an approximate right angle with the vertical section 16. The acute angle $\alpha$ is desirably within the range of about 20° to about 70°, and more desirably about 30° to about 60°.

Figure 2:
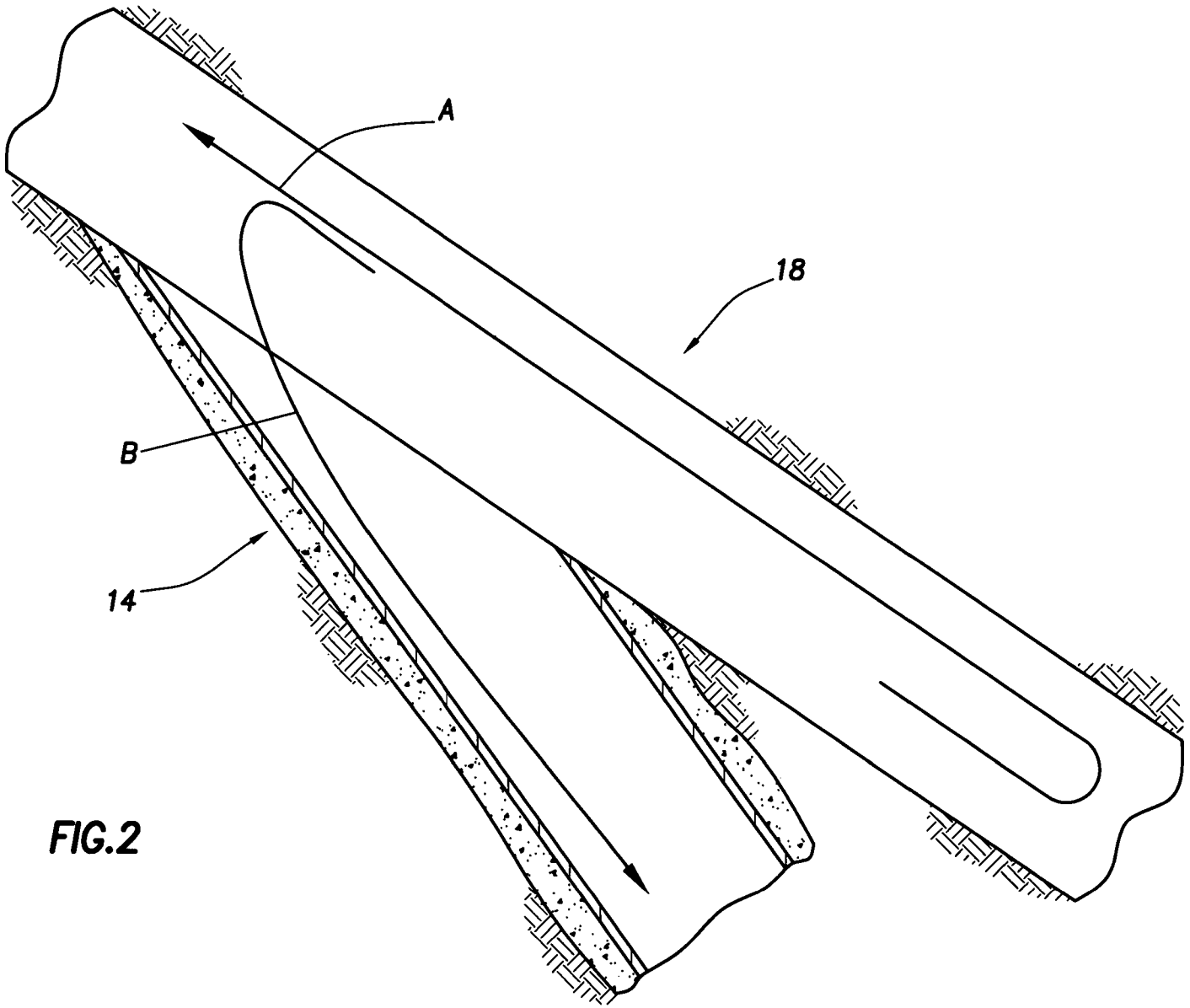
FIG. 2 is a schematic diagram illustrating the convective action of the wellbore configuration shown in FIG. 1.

The convective separation process in accordance with present invention is best illustrated in FIG. 2. The hydrocarbons, primarily oil and gas, mixed with other fluids and solids, primarily water and formation particles or fracturing proppants, are forced in a upward direction by either the action of a downhole pump or the reservoir pressure of the formation. Because the water and solids are heavier than the hydrocarbons, i.e., they have a higher specific gravity than the hydrocarbons, they have a tendency to separate from the hydrocarbons and fall to the bottom of the deviated section 18 of the primary bore 12, which because of its inclined nature creates a convective flow, as indicated by the arrow A. The opening of the secondary bore 14 in turn "catches" the heavier elements, namely the water and solids, into the secondary bore, which operates to accumulate these components, as indicated by the arrow B.

Figure 3:
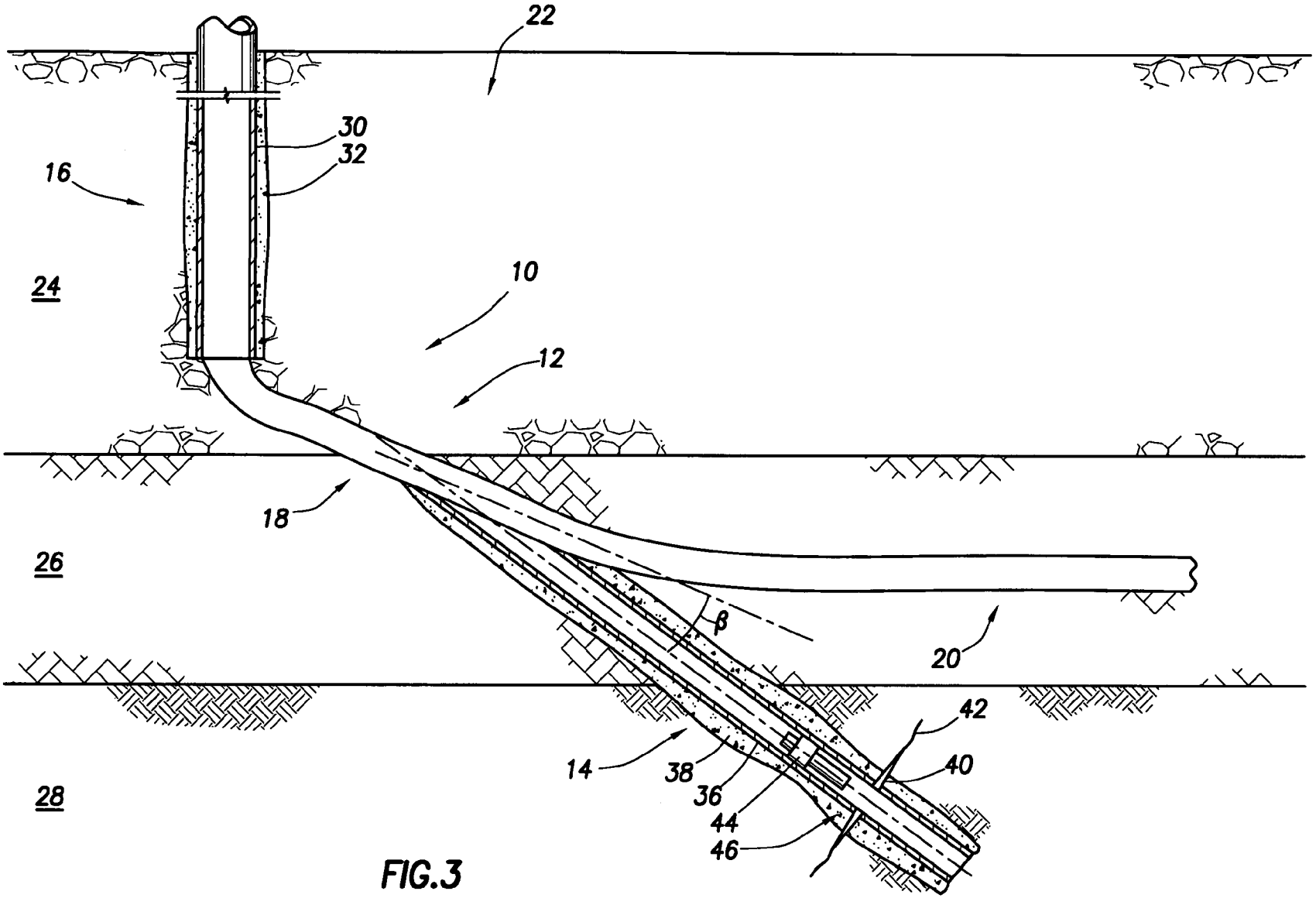
FIG. 3 illustrates an injection pump installed in the toe section of a secondary bore of the wellbore shown in FIG. 1.

It may be desirable to line the secondary bore 14 with a section of casing string 36, which may be cemented 38 to the subterranean formation 22 as required, so as to prevent the seepage of additional water into the secondary bore 14. It may also be desirable to form perforations 40 and possibly also fractures 42 in the subterranean formation 22, which intersect, and thereby communicate, with the secondary bore 14, as shown in FIG. 3. An injection pump 44 could possibly be installed in the toe section 46 of the secondary bore 14. The injection pump operates to pump the separated water back into the water containing formation, and thereby remove it from the system. The injection pump 44 may operate on a continual or intermittent basis depending upon the amount of water or solids present in the produced hydrocarbons.

Figure 4:
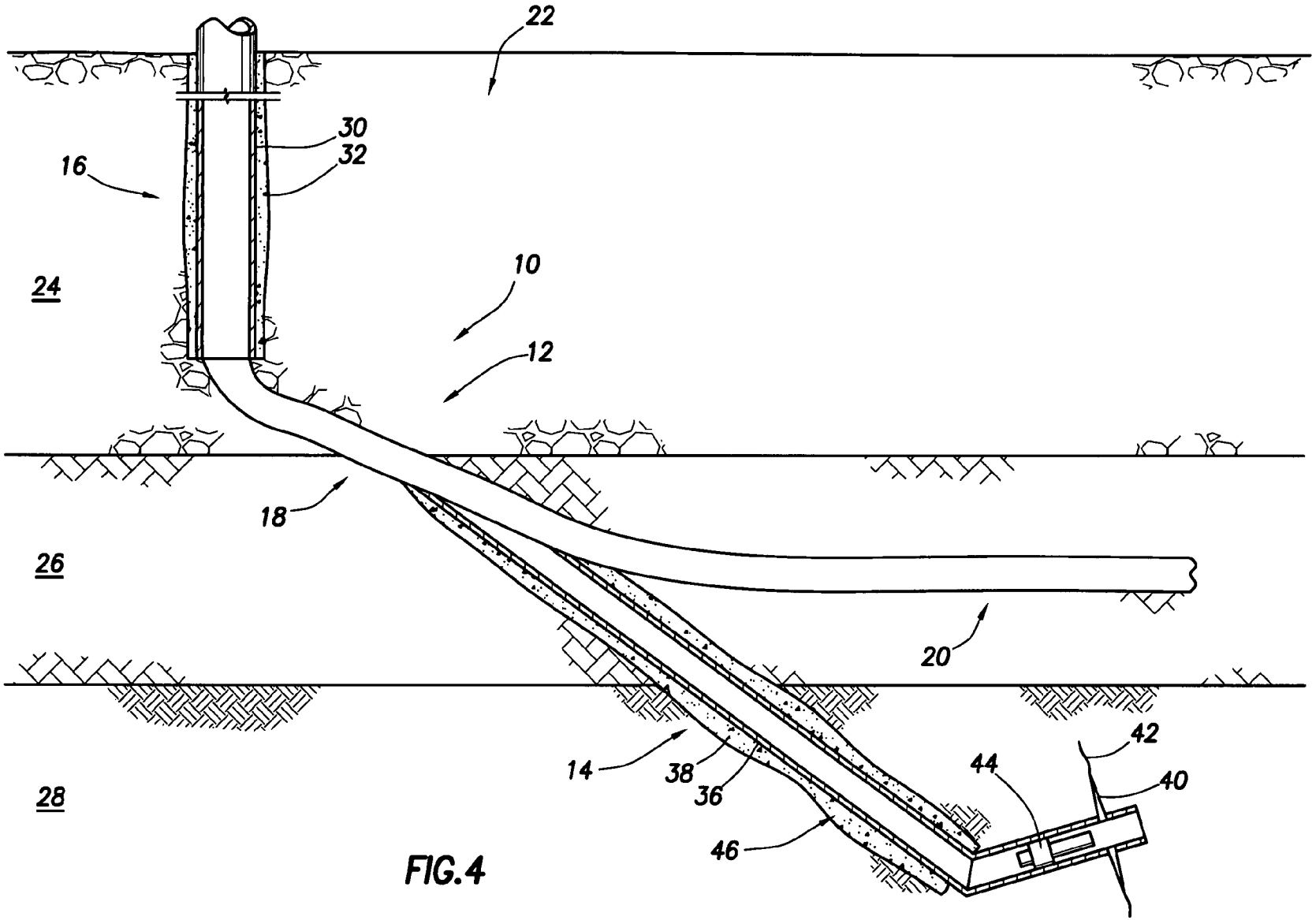
FIG. 4 illustrates a configuration where the toe section of the secondary bore shown in FIG. 3 is disposed at an acute angle to the remaining portion of the secondary bore in accordance with another embodiment of the present invention.

The embodiment of the present invention shown in FIG. 4 may be a more desirable configuration to use when solids are present in the produced fluids in more than trace amounts. This is because if the solids entering the secondary bore 14 accumulates excessively (builds up), they may plug the intake on the injection pump 44, which is placed directly in the flow path of the water/sand mixture. The embodiment shown in FIG. 4 is intended to prevent this from happening when there are more than trace amounts of sand in the production. In this embodiment, the toe section 46 of the secondary bore 14 is aligned at an acute angle β from the centerline of the secondary bore. The angle β is desirably between about 5° and about 45°, and more desirably about 15°. The injection pump 44 is thus placed at an angle to the remaining "straight" section of the secondary bore 14. The solids can therefore build up in the straight section of the secondary bore 14. It is possible to form a bridge in this section and therefore is not likely to build up in the upward angled toe section 46 of the secondary bore 14, where it could plug the intake to the injection pump 44. Accordingly, the solids can partially accumulate in the straight section of the secondary bore 14, while the water is pumped back into the water containing formation 28 via the injection pump 44. As with the previously described embodiments, once the sand builds up to the point that it starts to interfere with the flow of the separated hydrocarbons, the sand will need to be removed. This can be done using several techniques well known to those skilled in the art.

Figure 5:
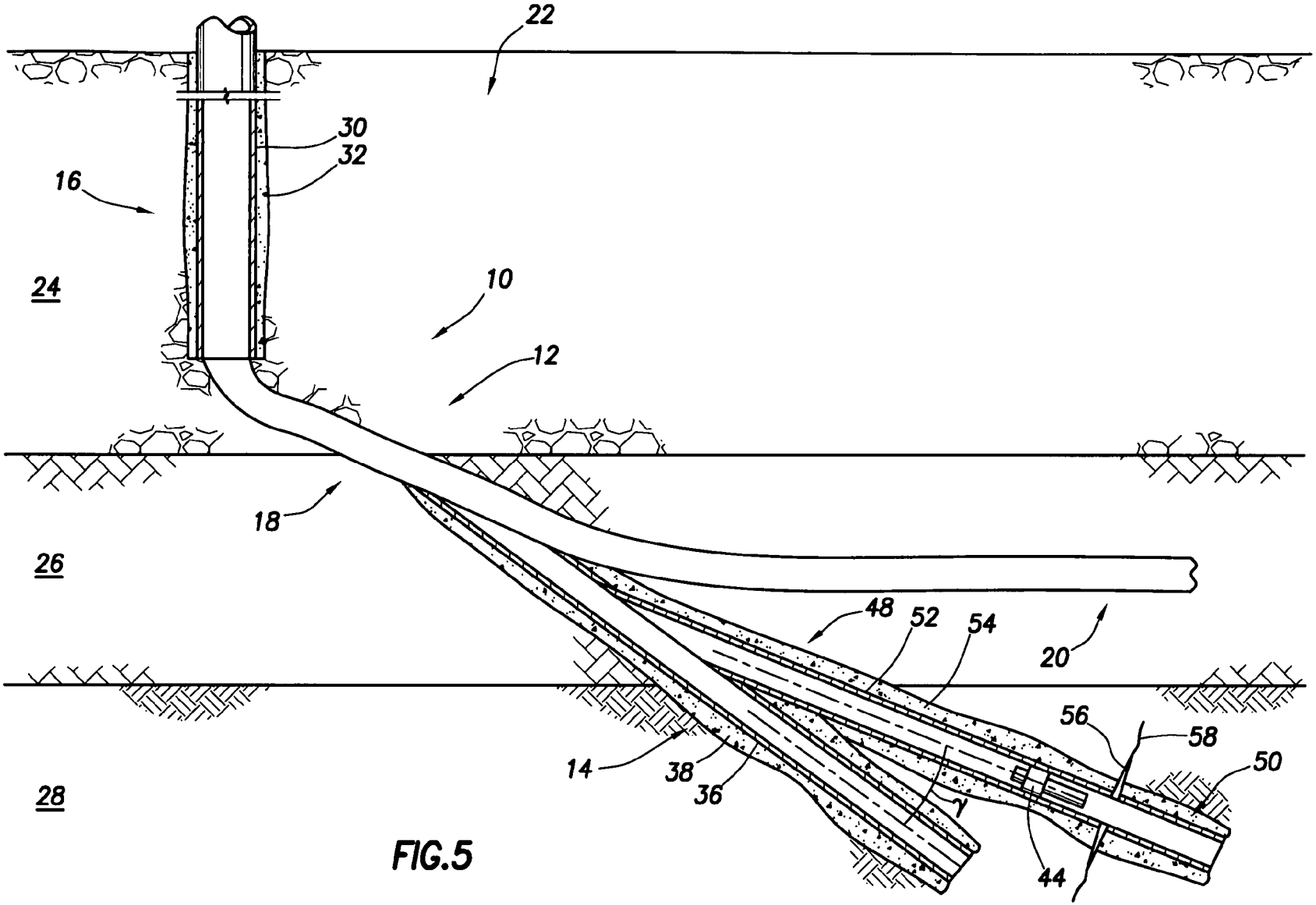
FIG. 5 is a schematic diagram of another embodiment of a wellbore configuration in accordance with the present invention, which employs a secondary bore and a tertiary bore.

Another wellbore completion design in accordance with the present invention is illustrated in FIG. 5. This design is similar to the embodiment shown in FIG. 3. The embodiment of FIG. 5, however, includes a tertiary bore 48. The tertiary bore 48 intersects, and communicates with, the secondary bore 14 at an acute angle γ, which is desirably between about 5° and about 45° and more desirably about 15°. In this embodiment, the injection pump 44 is disposed in the toe section 50 of the tertiary bore 48. The tertiary bore 48 may also be lined with a section of casing string 52, which may be cemented 54 to the subterranean formation. The section of casing string 52 prevents the seepage of water into the tertiary bore 48. In this embodiment, the perforations 56 and fractures 58 (if present) desirably intersect with the tertiary bore 48. In this embodiment, the secondary bore 14 accumulates the solids, which are heavier than the water, and therefore settles in the lower of the two lower bores of the wellbore 10. Indeed, the convective effect also occurs in the secondary bore 14 wherein flow of the lighter element, water, rises to the top part of the secondary bore 14 and flow of the heavier element, solids, falls to the bottom part of the secondary bore. The water flowing in the top half of the secondary bore 14 is then directed into the tertiary bore 48, wherein the injection pump 44 forces it back into the subterranean formation 22 via perforations 56 and (if present) fractures 58. As those of ordinary skill in the art will appreciate the wellbore design shown in FIG. 5 can easily be modified such that the tertiary bore 48 intersects the primary bore 12 in the deviated section 18. In this embodiment, the secondary bore 14 would operate in the same way but would intersect the tertiary bore 48 at a point below where the tertiary bore 48 intersects deviated section 18.

In another embodiment of the present invention, the deviated section 18 of the wellbore 10 serves both to separate the water and sand from the oil and gas and also to accumulate the water and sand. There is no secondary bore 14 or tertiary bore 48 in this embodiment. In order to effectively accumulate the water and sand in this configuration, therefore, it is desirable that the deviated section 18 of the wellbore 10 be unperforated and unfractured. This will thereby prevent the seepage of water and other elements into the wellbore 10, which may interfere with the production of the hydrocarbons and the accumulation of the separated elements. In one exemplary version of this embodiment, the deviated section 18 of the wellbore is about one hundred feet (100 ft) or more, as noted above. It is particularly important that the unperforated portion of the deviated section 18 of the wellbore, which is used for the separation of the water and sand from the hydrocarbons, be of sufficient length that it does not become plugged before desired. Furthermore, as also noted above, the deviated section 18 of the wellbore 10 is desirably formed at an acute angle α to the horizontal 34, which is desirably within the range of about 30° to about 60°, and more desirably about 45°.

Figure 6:
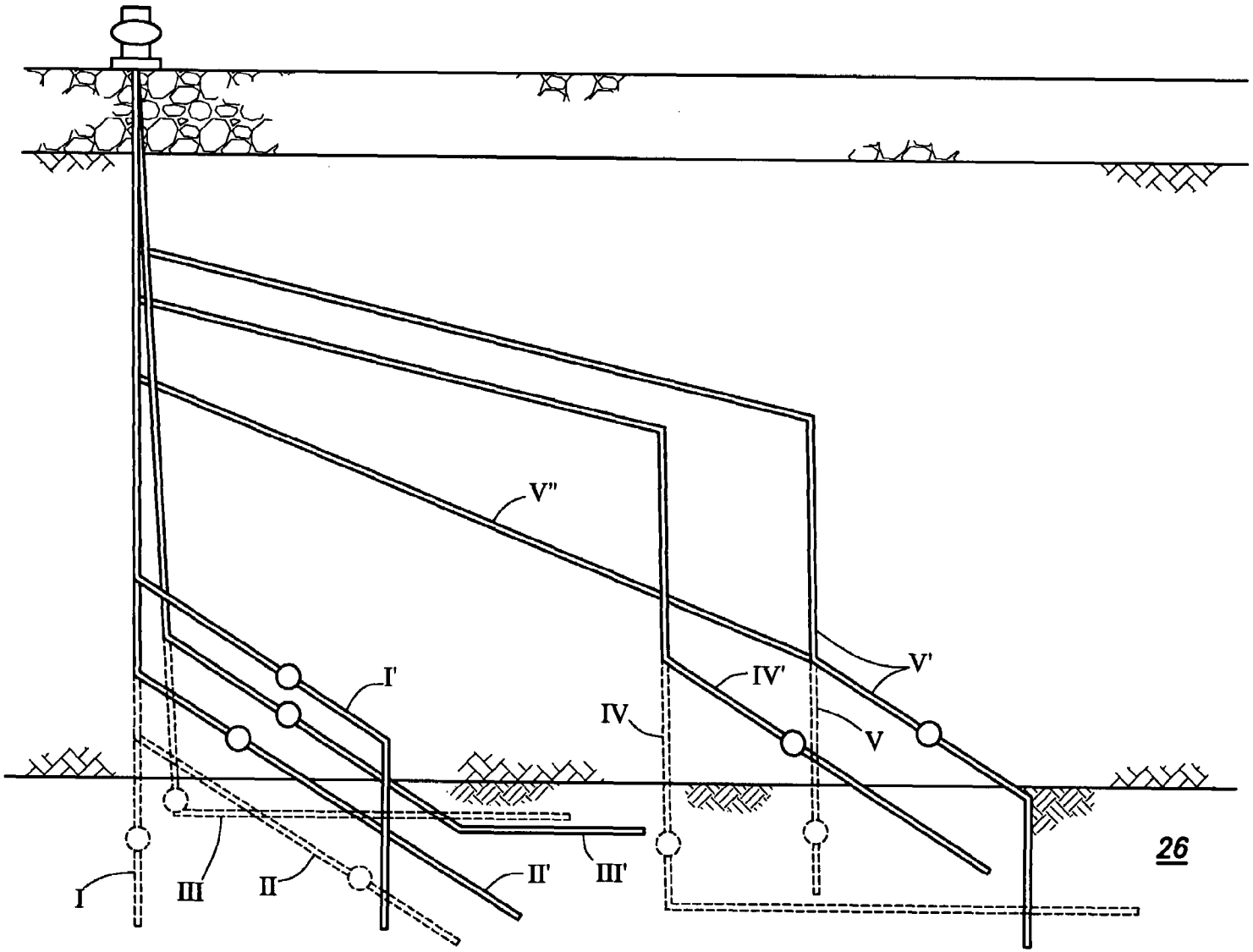
FIG. 6 illustrates incorporation of yet another embodiment of a wellbore configuration in accordance with the present invention into conventional wellbore designs.

FIG. 6 illustrates this embodiment as incorporated into five different potential conventional wellbore configurations. The conventional wellbore configurations are identified by the dashed lines and labeled with the designations I-V. The wellbore configurations according to the present invention, which are modifications to the conventional designs that incorporate the unperforated deviated section 18, are indicated by the solid black lines and labeled with the designations I'-V'. The Type V conventional design has two modifications in accordance with the present invention shown, namely Type V' and Type V". The circles shown in FIG. 6 indicates a desirable location of a production pump or production assembly tip. As can be seen from FIG. 6 all the pumps or production assembly tips in the conventional wellbore designs are located in the production zone 26. The production pumps or production assembly tips in the wellbore configurations in accordance with the present invention, however, are all located above the production zone 26, namely in the non-producing zone 24. Furthermore, the production pumps or production assembly tips in the wellbore configurations in accordance with the present invention are all located in the unperforated portion of the deviated section 18 of the wellbore 10. The separation of the water and solids from the hydrocarbons will occur, via the convective separation phenomenon described above, below the pumps or production assembly tips, so that the only fluid that encounters the pumps or production assembly tips is a mixture of essentially hydrocarbons with no or very little water or solids.

As those of ordinary skill in the art will appreciate, the present invention has application in virtually any type of well. For example, it can be used in multilateral wells and wells with fish bones as well as other wells not mentioned herein. Therefore, the present invention is well adapted to attain the ends and advantages mentioned as well as those that are inherent therein. While numerous changes may be made by those skilled in the art, such changes are encompassed within the spirit of this invention as defined by the appended claims

What is claimed is:

1. A method of separating other fluids and solids from hydrocarbons being produced from a subterranean formation, comprising the steps of:

(a) forming a primary wellbore having a deviated section in the subterranean formation, which stimulates convective separation of the other fluids and solids from the hydrocarbons during production of the hydrocarbons from the subterranean formation; and (b) forming a secondary bore, which intersects the deviated section of the primary wellbore at an acute angle and which accumulates one or more of the other fluids and solids separated from the hydrocarbons.

2. The separation method according to claim 1, further comprising the step of installing a section of casing string in the secondary bore.

3. The separation method according to claim 2, further comprising the step of cementing the section of casing string to an inner wall of the secondary bore.

4. The separation method according to claim 1, further comprising the step of forming perforations into the subterranean formation, which intersect with the secondary bore.

5. The separation method according to claim 4, further comprising the step of forming hydraulic fractures in the subterranean formation, which intersect with the secondary bore.

6. The separation method according to claim 1, wherein the secondary bore has a toe section and the method further comprises the step of installing an injection pump in the toe section of the secondary bore, which pumps at least the other fluids separated from the hydrocarbons back into the subterranean formation.

7. The separation method according to claim 6, wherein the toe section of the secondary bore forms an acute angle with the remaining portion of the secondary bore.

8. The separation method according to claim 1, further comprising the step of drilling a tertiary bore, which intersects the secondary bore at an acute angle.

9. The separation method according to claim 8, wherein the solids accumulate in the secondary bore.

10. The separation method according to claim 9, wherein the other fluids flow into the tertiary bore.

11. The separation method according to claim 8, wherein the tertiary bore has a toe section and the method further comprises the step of installing an injection pump in the toe section of the tertiary bore.

12. The separation method according to claim 8, further comprising the step of installing a section of casing string in the tertiary bore.

13. The separation method according to claim 12, further comprising the step of cementing the section of casing string to an inner wall of the tertiary bore.

14. The separation method according to claim 8, further comprising the step of forming perforations into the subterranean formation, which intersect with the tertiary bore.

15. The separation method according to claim 14, further comprising the step of forming fractures in the subterranean formation, which intersect with the tertiary bore.

16. The separation method according to claim 1, wherein the acute angle is in the range of about 20-70°.

17. The separation method according to claim 16, wherein the acute angle is in the range of about 30-60°.

18. A method of separating other fluids and solids from hydrocarbons being produced from a subterranean formation, comprising the step of forming an unperforated deviated section of a wellbore at an acute angle to horizontal, the unperforated deviated section of the wellbore stimulating convective separation of the other fluids and solids from the hydrocarbons during production of the hydrocarbons in the subterranean formation; and the step of forming a secondary bore, which intersects the unperforated deviated section of the wellbore at an acute angle and which accumulates one or more of the other fluids and solids separated from the hydrocarbons.

19. The separation method according to claim 18, further comprising the step of installing a section of casing string in the secondary bore.

20. The separation method according to claim 19, further comprising the step of cementing the section of casing string to an inner wall of the secondary bore.

21. The separation method according to claim 18, further comprising the step of forming perforations into the subterranean formation, which intersect with the secondary bore.

22. The separation method according to claim 21, further comprising the step of forming hydraulic fractures in the subterranean formation, which intersect with the secondary bore.

23. The separation method according to claim 18, wherein the secondary bore has a toe section and the method further comprises the step of installing an injection pump in the toe section of the secondary bore, which pumps at least the other fluids separated from the hydrocarbons back into the subterranean formation.

24. The separation method according to claim 23, wherein the toe section of the secondary bore forms an acute angle with the remaining portion of the secondary bore.

25. The separation method according to claim 18, further comprising the step of forming a tertiary bore, which intersects the secondary bore at an acute angle.

26. The separation method according to claim 25, wherein the solids accumulate in the secondary bore.

27. The separation method according to claim 26, wherein the other fluids flow into the tertiary bore.

28. The separation method according to claim 25, wherein the tertiary bore has a toe section and the method further comprises the step of installing an injection pump in the toe section of the tertiary bore.

29. The separation method according to claim 25, further comprising the step of installing a section of casing string in the tertiary bore.

30. The separation method according to claim 29, further comprising the step of cementing the section of casing string to an inner wall of the tertiary bore.

31. The separation method according to claim 25, further comprising the step of forming perforations into the subterranean formation, which intersect with the tertiary bore.

32. The separation method according to claim 31, further comprising the step of forming hydraulic fractures in the subterranean formation, which intersect with the tertiary bore.

33. The separation method according to claim 18, wherein the acute angle is in the range of about 20-70°.

34. The separation method according to claim 33, wherein the acute angle is in the range of about 30-60°.

35. A wellbore adapted to separate other fluids and solids from hydrocarbons being produced from a subterranean formation, comprising a primary bore having a deviated section, which stimulates convective separation of the other fluids and solids from the hydrocarbons during production of the hydrocarbons from the subterranean formation and a secondary bore, which intersects the deviated section of the primary wellbore at an acute angle and which accumulates one or more of the other fluids and/or solids separated from the hydrocarbons.

36. The wellbore according to claim 35, wherein the secondary bore is lined with a section of casing string.

37. The wellbore according to claim 36, wherein the casing string is cemented to an inner wall of the secondary bore.

38. The wellbore according to claim 37, further comprising a plurality of fractures in the subterranean formation, which open to the secondary bore.

39. The wellbore according to claim 38, further comprising an injection pump installed in a toe section of the secondary bore, which is adapted to pump the other fluids back into the subterranean formation via the plurality of fractures.

40. The wellbore according to claim 39, wherein the toe section of the secondary bore forms an acute angle with the remaining portion of the secondary bore.

41. The wellbore according to claim 35, further comprising a tertiary bore, which intersects the secondary bore at an acute angle.

42. The wellbore according to claim 41, wherein the solids accumulate in the secondary bore.

43. The wellbore according to claim 42, wherein the other fluids flow into the tertiary bore.

44. The wellbore according to claim 41, wherein the tertiary bore has a toe section and an injection pump is installed in the toe section of the tertiary bore.

45. The wellbore according to claim 41, wherein a section of casing string is installed in the tertiary bore.

46. The wellbore according to claim 45, wherein the section of casing string is cemented to an inner wall of the tertiary bore.

47. The wellbore according to claim 41, wherein perforations into the subterranean formation intersect with the tertiary bore.

48. The wellbore according to claim 47, wherein fractures in the subterranean formation intersect with the tertiary bore.

49. The wellbore according to claim 35, wherein the acute angle that the secondary bore forms with the primary bore is in the range of about 20-70°.

50. The wellbore according to claim 49, wherein the acute angle that the secondary bore forms with the primary bore is in the range of about 30-60°.

51. A wellbore adapted to separate other fluids and solids from hydrocarbons being produced from a subterranean formation, comprising a primary bore having an unperforated deviated section, which is oriented at an acute angle to horizontal that stimulates convective separation of the other fluids and solids from the hydrocarbons during production of the hydrocarbons from the subterranean formation; and a secondary bore, which intersects the unperforated deviated section of the primary bore at an acute angle and which accumulates one or more of the other fluids and solids separated from the hydrocarbons.

52. The wellbore according to claim 51, wherein the secondary bore is lined with a section of casing string.

53. The wellbore according to claim 52, wherein the casing string is cemented to an inner wall of the secondary bore.

54. The wellbore according to claim 51, further comprising a plurality of fractures in the subterranean formation, which open to the secondary bore.

55. The wellbore according to claim 54, further comprising an injection pump installed in a toe section of the secondary bore, which is adapted to pump the other fluids back into the subterranean formation via the plurality of fractures.

56. The wellbore according to claim 55, wherein the toe section of the secondary bore forms an acute angle with the remaining portion of the secondary bore.

57. The wellbore according to claim 51, further comprising a tertiary bore, which intersects the secondary bore at an acute angle.

58. The wellbore according to claim 57, wherein the solids accumulate in the secondary bore.

59. The wellbore according to claim 58, wherein the other fluids flow into the tertiary bore.

60. The wellbore according to claim 57, wherein the tertiary bore has a toe section and an injection pump is installed in the toe section of the tertiary bore.

61. The wellbore according to claim 57, wherein a section of casing string is installed in the tertiary bore.

62. The wellbore according to claim 61, wherein the section of casing string is cemented to an inner wall of the tertiary bore.

63. The wellbore according to claim 57 wherein perforations into the subterranean formation intersect with the tertiary bore.

64. The wellbore according to claim 63, wherein fractures in the subterranean formation intersect with the tertiary bore.

65. The wellbore according to claim 51, wherein the acute angle that the secondary bore forms with the unperforated deviated section of the primary bore is in the range of about 20-70°.

66. The wellbore according to claim 65, wherein the acute angle that the secondary bore forms with unperforated deviated section of the primary bore is in the range of about 30-60°.

* * * * *